US012566031B2

(12) United States Patent
Shin

(10) Patent No.: US 12,566,031 B2
(45) Date of Patent: Mar. 3, 2026

(54) HEAT EXCHANGER

(71) Applicant: Hanon Systems, Daejeon (KR)

(72) Inventor: Sung Hong Shin, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 111 days.

(21) Appl. No.: 18/284,097

(22) PCT Filed: Aug. 11, 2022

(86) PCT No.: PCT/KR2022/012012

§ 371 (c)(1),
(2) Date: Sep. 26, 2023

(87) PCT Pub. No.: WO2023/018251

PCT Pub. Date: Feb. 16, 2023

(65) Prior Publication Data

US 2024/0151477 A1 May 9, 2024

(30) Foreign Application Priority Data

Aug. 11, 2021 (KR) ..... 10-2021-0105934

(51) Int. Cl.
*F28D 9/00* (2006.01)
*F28F 3/08* (2006.01)
*F28F 9/02* (2006.01)

(52) U.S. Cl.
CPC ..... *F28D 9/0075* (2013.01); *F28F 9/02* (2013.01)

(58) Field of Classification Search
CPC .... B60H 2001/2278; B60H 1/22; B60H 1/14; B60H 1/143; F28F 9/0275; F28F 9/0256; F28F 9/0246; F28F 3/086; F28F 3/08; F28D 9/0093; F28D 9/005; F25B 2313/0233
See application file for complete search history.

(56) References Cited

U.S. PATENT DOCUMENTS

2007/0119431 A1* 5/2007 Harada ..... F02B 29/0456 165/173
2015/0323231 A1* 11/2015 Citti ..... F28D 9/005 62/516
2015/0369115 A1* 12/2015 Kim ..... F28F 27/02 165/103
2017/0246933 A1* 8/2017 Lee ..... B60H 1/00335
(Continued)

FOREIGN PATENT DOCUMENTS

CN 1015277013 1/2016
CN 20721247 4/2018
(Continued)

OTHER PUBLICATIONS

International Search Report issued in PCT/KR2022/012012 on Nov. 15, 2022.
(Continued)

*Primary Examiner* — Frantz F Jules
*Assistant Examiner* — Jason N Thompson
(74) *Attorney, Agent, or Firm* — NORTON ROSE FULBRIGHT US LLP

(57) ABSTRACT

The present invention relates to a heat exchanger, and more particularly, to a heat exchanger in which a branch pipe is disposed adjacent to a coolant discharge port, which may miniaturize an entire heat exchange system and improve packageability.

11 Claims, 10 Drawing Sheets

(56) References Cited

U.S. PATENT DOCUMENTS

| | | | | |
|---|---|---|---|---|
| 2019/0154366 | A1* | 5/2019 | Mueller | F28D 1/03 |
| 2020/0173593 | A1* | 6/2020 | Tolhurst | B01J 8/22 |
| 2020/0353790 | A1* | 11/2020 | Miyoshi | B60H 1/32284 |
| 2021/0079834 | A1 | 3/2021 | Wang et al. | |
| 2021/0095927 | A1* | 4/2021 | Yang | F28F 9/0275 |

FOREIGN PATENT DOCUMENTS

| | | | | |
|---|---|---|---|---|
| CN | 109312988 | | 2/2019 | |
| CN | 112513543 | | 3/2021 | |
| FR | 3093558 | A1 * | 9/2020 | F28F 27/02 |
| JP | 2013185790 | A | 9/2013 | |
| JP | 5888425 | B2 | 3/2016 | |
| KR | 100160867 | B1 | 1/1999 | |
| KR | 20190023263 | A | 3/2019 | |
| KR | 20200110013 | | 9/2020 | |
| KR | 20210034954 | A | 3/2021 | |

OTHER PUBLICATIONS

Official Action issued Nov. 7, 2025 in related Korean Patent Application No. 10-2021-0105934, 7 pgs.
English translation of Official Action issued Dec. 4, 2025 in related Chinese Patent Application No. 202280027692.1 , 18 pgs.

* cited by examiner

HEAT EXCHANGER

CROSS REFERENCE TO RELATED APPLICATIONS

This patent application is a national phase under 35 U.S.C. § 371 of International Patent Application No. PCT/KR2022/012012 filed Aug. 11, 2022, which claims the benefit of priority from Korean Patent Application No. 10-2021-0105934 filed Aug. 11, 2021, each of which is hereby incorporated herein by reference in its entirety for all purposes.

TECHNICAL FIELD

The present invention relates to a heat exchanger, and more particularly, to a heat exchanger in which a branch pipe is disposed adjacent to a coolant discharge port, which may miniaturize an entire heat exchange system and improve packageability.

BACKGROUND ART

In a refrigeration cycle of a general air conditioner for a vehicle, an actual cooling operation is performed by the evaporator in which a liquid heat exchange medium is vaporized by absorbing the amount of heat corresponding to vaporization heat from the surroundings. A gaseous heat exchange medium, which is introduced into the compressor from the evaporator, is compressed into a high-temperature, high-pressure heat exchange medium by the compressor, and the compressed gaseous heat exchange medium is liquefied while passing through the condenser, such that liquefaction heat is discharged to the periphery. The liquefied heat exchange medium is converted into low-temperature, low-pressure wet saturated vapor while passing through the expansion valve again, and then the heat exchange medium is introduced into the evaporator again. Therefore, these processes define a cycle.

That is, the condenser may be an air-cooled condenser or a liquid-cooled condenser. The air-cooled condenser uses air as a heat exchange medium, and the liquid-cooled condenser uses a liquid as heat exchange medium. The heat exchange medium serves to cool a refrigerant. A high-temperature, high-pressure gaseous refrigerant is introduced into the condenser, condensed while performing heat exchange and radiating liquefaction heat, and then discharged in a liquid state. Recently, among the condensers, the liquid-cooled condensers have been widely used with the proliferation of electric vehicles.

FIG. 1 is a view illustrating a liquid-cooled condenser in the related art. A liquid-cooled condenser 20 may have a structure in which a plurality of plates 23 is stacked. More specifically, first and second flow parts 21 and 22, through which first and second heat exchange media flow, are formed by stacking the plurality of plates 23, and the liquid-cooled condenser 20 may include a first inlet pipe 31 and a first outlet pipe 32 through which the first heat exchange medium is introduced and discharged, a second inlet pipe 41 and a second outlet pipe 42 through which the second heat exchange medium is introduced and discharged, a gas-liquid separator 50 configured to separate the first heat exchange medium into a gaseous heat exchange medium and a liquid heat exchange medium, a first connection pipe 51 configured to connect a condensation region of the first flow part 21 and a gas-liquid separator 50, and a second connection pipe 52 configured to connect the gas-liquid separator 50 and a supercooling region of the first flow part 21.

In the liquid-cooled condenser 20, the first heat exchange medium introduced through the first inlet pipe 31 flows in the condensation region of the first flow part 21 and flows to the gas-liquid separator 50 through the first connection pipe 51. The first heat exchange medium flows in the supercooling region of the first flow part 21 through the second connection pipe 52 and is discharged through the first outlet pipe 32. In this case, the second heat exchange medium is introduced through the second connection pipe 52 and flows to the second flow part 22 formed alternately with the first flow part 21, such that heat exchange may occur between the first heat exchange medium and the second heat exchange medium. In this case, the first heat exchange medium may correspond to a refrigerant, and the second heat exchange medium may correspond to a coolant.

Meanwhile, in an electric vehicle, the liquid-cooled condenser serves as a condenser for condensing the refrigerant during a cooling process and serves as an evaporator for evaporating the refrigerant during a heating process. The liquid-cooled condenser needs to evaporate the refrigerant with a relatively low-temperature coolant during the cooling process, i.e., so that the liquid-cooled condenser serves as a condenser function. To this end, the coolant is maintained at a relatively low temperature by means of heat exchange in a radiator. The liquid-cooled condenser needs to heat the refrigerant with a relatively high-temperature coolant during the heating process, i.e., so that the liquid-cooled condenser serves as an evaporator. To this end, the coolant is maintained at a relatively high temperature by means of waste heat from a PE component (electrical component). In this case, it is not necessary to cool the coolant by means of the radiator during the heating process.

It is necessary to regulate a coolant path to perform the above-mentioned appropriate functions. Therefore, in the related art, a valve or the like is installed in the coolant path. However, the limited space and the constraint on the packaging make it difficult to install the valve and cause a problem in which unnecessary space is occupied, and a valve installation process or the like is additionally required.

DOCUMENT OF RELATED ART

Korean Patent Application Laid-Open No. 10-2021-0034954 (published on Mar. 31, 2021)

DISCLOSURE

Technical Problem

The present invention has been made in an effort to solve the above-mentioned problem, and an object of the present invention is to provide a heat exchanger in which a branch pipe is provided adjacent to a coolant discharge port, such that an entire heat exchange system may be miniaturized, and packageability may be improved.

Technical Solution

A heat exchanger according to an example of the present invention may include: a core part in which heat exchange occurs between a refrigerant and a coolant; a refrigerant inlet port through which the refrigerant is introduced into the core part; a refrigerant discharge port through which the refrigerant is discharged from the core part; a coolant inlet port through which the coolant is introduced into the core part; a coolant discharge port through which the coolant is discharged from the core part; and a branch pipe provided adjacent to the coolant discharge port and configured to distribute the coolant to different paths.

The branch pipe may include: a coolant discharge pipe through which the coolant is introduced from the coolant discharge port; and first and second branch pipes branching off from the coolant discharge pipe.

The first branch pipe may transfer the coolant to a first coolant path, the second branch pipe may transfer the coolant to a second coolant path, the first coolant path may be a path in which the coolant is cooled, and the second coolant path may be a path in which the coolant is heated.

The coolant having moved to the first branch pipe may move to a path passing through a radiator configured to exchange heat with outside air to decrease a temperature of the coolant, and the coolant having moved to the second branch pipe may be heated by waste heat of an electrical component having a relatively higher temperature than the coolant.

An outer diameter of the first branch pipe may be equal to or larger than an outer diameter of the second branch pipe.

The coolant discharge pipe may be disposed downward from the first and second branch pipes in a gravitational direction.

The branch pipe may have a structure in which the first and second branch pipes constitute an integrated pipe, and an end of the coolant discharge pipe is coupled to a middle portion of a lateral side of the integrated pipe.

The integrated pipe and the coolant discharge pipe may be coupled by welding.

A bead portion may be provided at a coupling side end of the coolant discharge pipe and have a coupling surface having a shape being in close contact with an outer peripheral surface of the integrated pipe.

At least one protruding portion may be provided on the integrated pipe and protrude in a ring shape along an outer peripheral surface of the integrated pipe.

The heat exchanger may further include: a fixing structure configured to fix the branch pipe.

One end of the fixing structure may be fixed to the coolant discharge pipe, and the other end of the fixing structure may be fixed to the core part.

The coolant discharge pipe may include a bent portion extending from the core part and bent toward the first and second branch pipes, one end of the fixing structure may be fixed to one point on the coolant discharge pipe, the other end of the fixing structure may be fixed to the other point on the coolant discharge pipe, and the bent portion may be positioned between one point and the other point.

At least one of one end and the other end of the fixing structure may surround an outer peripheral surface of the coolant discharge pipe.

The branch pipe may be positioned upward from the core part.

The core part may include a condensation region and a supercooling region for the refrigerant, and the heat exchanger may further include a gas-liquid separator provided at one side of the core part.

The core part may be configured such that a plurality of plates, on which the coolant forward, and a plurality of plates, on which the refrigerant flows, are alternately stacked to perform heat exchange.

Advantageous Effects

According to the present invention, the branch pipe is provided adjacent to the coolant discharge port, such that the entire heat exchange system may be miniaturized, and the packageability may be improved.

MODE FOR INVENTION

Hereinafter, the present invention will be described with reference to the accompanying drawings.

Figure 1:
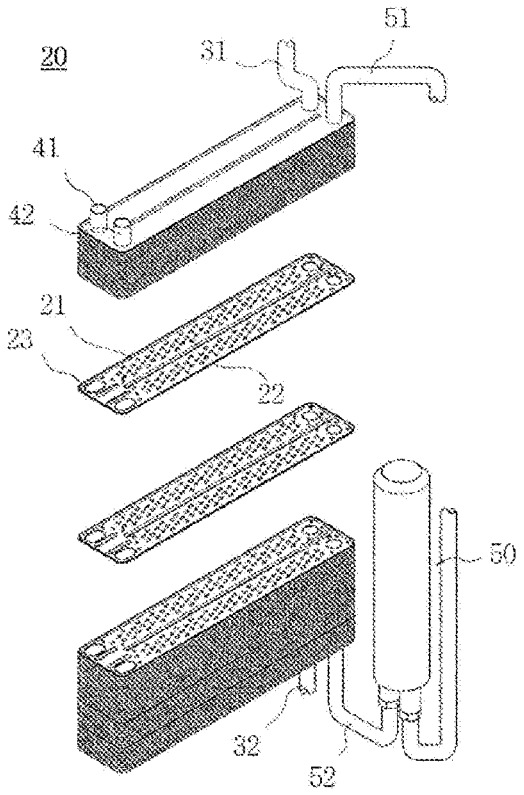
FIG. 1 is a view illustrating a liquid-cooled condenser in the related art.
Figure 2:
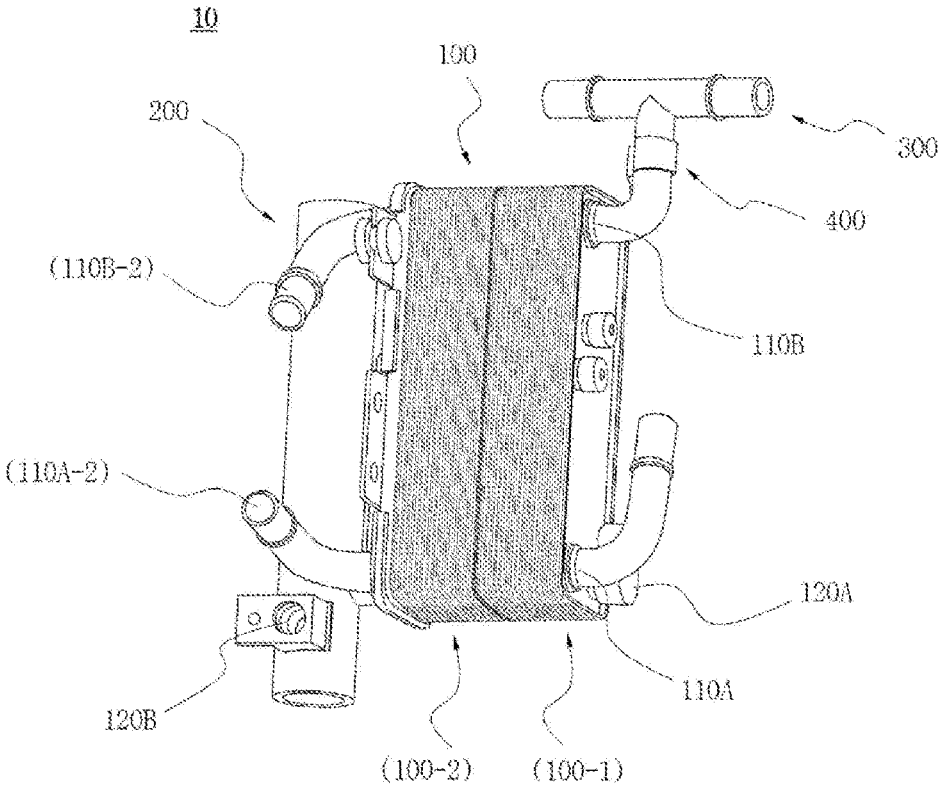
FIG. 2 is a view illustrating a heat exchanger according to an example of the present invention.
Figure 3:
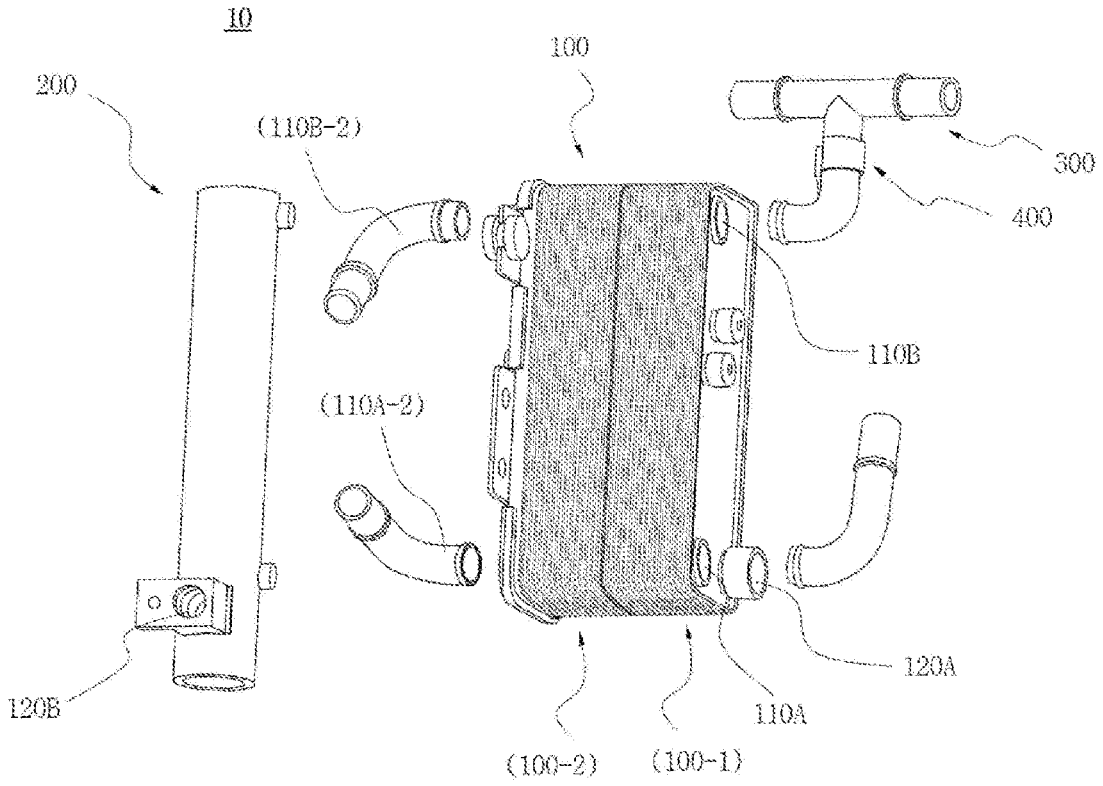
FIG. 3 is an exploded perspective view of FIG. 2.

FIG. 2 is a view illustrating a heat exchanger according to an example of the present invention, and FIG. 3 is an exploded perspective view of FIG. 2. A heat exchanger 10 includes a core part 100 in which heat exchange occurs between a refrigerant and a coolant, a coolant inlet port 110A and a coolant discharge port 110B through which the coolant is introduced and discharged, a refrigerant inlet port 120A and a refrigerant discharge port 120B through which the refrigerant is introduced and discharged. The heat exchanger 10 may further include a gas-liquid separator 200.

The core part 100 is a part in which the refrigerant and the coolant flow, and the refrigerant and the coolant exchange heat with each other. As described in the background art section, the core part 100 may have a structure in which a refrigerant flow part and a coolant flow part formed by alternately stacking a plurality of plates on which the coolant flows and a plurality of plates on which the refrigerant flows, for example. In this structure, the core part 100 may include a condensation region and a supercooling region for the refrigerant.

The coolant inlet port 110A may be provided at one side of the core part, e.g., a right lower side of the core part based on the drawings, such that the coolant may be introduced into the core part from the outside. The coolant discharge port 110B may be provided at the other side of the core part, e.g., a right upper side of the core part based on the drawings, such that the coolant may be discharged to the outside. As described below, a branch pipe 300 may be provided adjacent to the coolant inlet port 110A, and a general coolant discharge pipe may be provided adjacent to the coolant discharge port 110B.

Meanwhile, the heat exchanger illustrated in FIG. 2 is a double-sided heat exchanger and has a structure in which a first core part 100-1, through which the coolant which circulates through a first coolant path flows, and a second core part 100-2, through which the coolant which circulates through a second coolant path flows, are stacked in a leftward/rightward direction based on the drawings (also generally described as being stacked in an upward/downward direction based on the core part). The two pipes provided at the left side based on the drawings may correspond to a second coolant inflow pipe 110A-2 and a second coolant discharge pipe 110B-2 through which the coolant circulating through the second coolant path is introduced and discharged. However, the following features of the present invention may, of course, be applied to an integrated heat exchanger, in which a first coolant path and a second coolant path are integrated, or a heat exchanger, which has a single core part installed in a single coolant path, as much as needed, as well as the illustrated in double-sided heat exchanger.

The gas-liquid separator 200 may be provided at one side of the core part and serve to separate the liquid refrigerant and the gaseous refrigerant from the refrigerant in which the liquid refrigerant and the gaseous refrigerant are mixed. The gas-liquid separator 200 may have a structure coupled to one side of the core part, e.g., the left side of the core part by brazing.

The refrigerant inlet port 120A may be provided at one side of the core part, e.g., the right lower side of the core part based on the drawings, such that the refrigerant may be introduced into the core part from the outside. The refrigerant discharge port 120B may be provided at one side of the gas-liquid separator, e.g., a lower side of the gas-liquid separator based on the drawings, such that the refrigerant may be discharged to the outside.

In the heat exchanger 10, the present invention may have the branch pipe 300 provided adjacent to the coolant discharge port 110B and configured to distribute the coolant, which is discharged from the coolant discharge port 110B, to different paths. Because the branch pipe is installed adjacent to the coolant discharge port, the coolant, which has performed the heat exchange in the core part and been discharged, may flow to an appropriate path. In this case, unlike the related art, a branch pipe or valve need not be installed at a position provided separately from the heat exchanger. Therefore, it is possible to reduce the number of additional components, miniaturize the entire heat exchange system, and improve the packageability of the heat exchanger.

Figure 4:
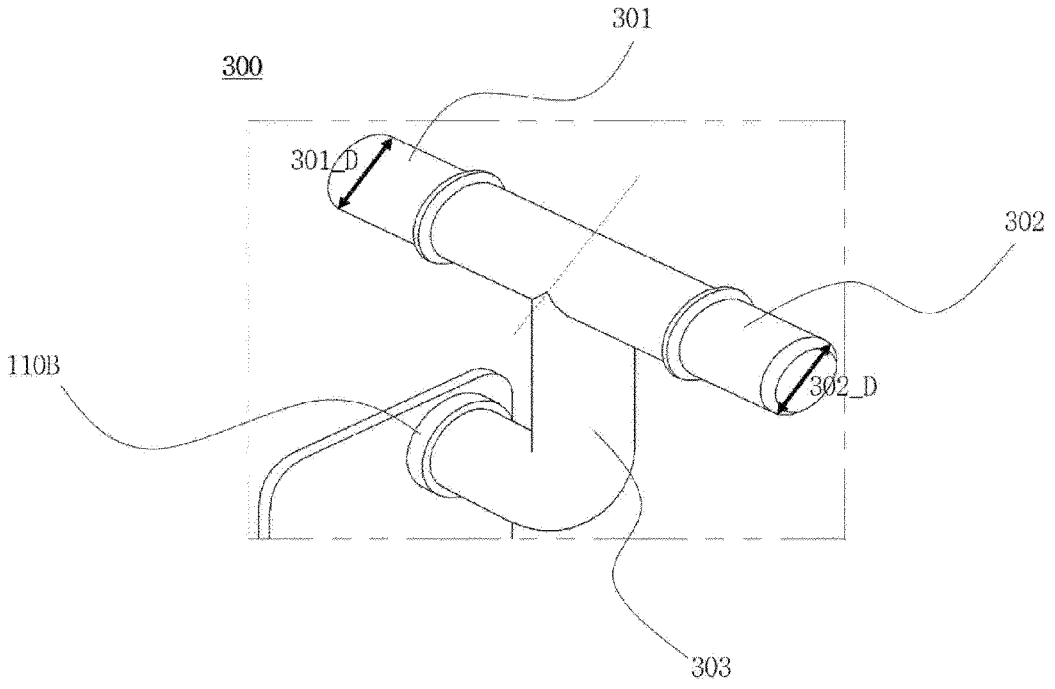
FIG. 4 is a view illustrating a branch pipe according to the example of the present invention.
Figure 5:
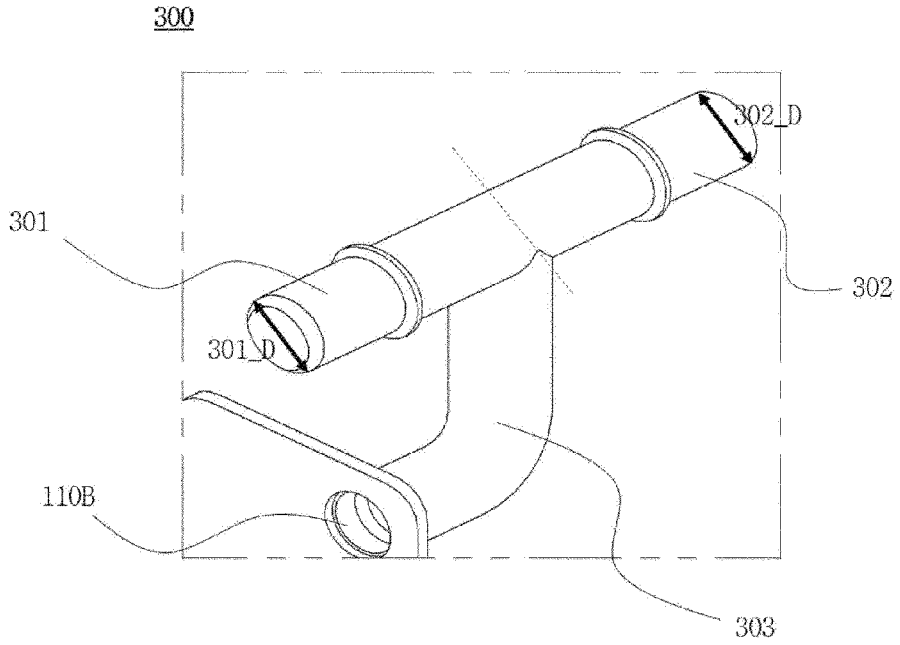
FIG. 5 is a view illustrating a branch pipe according to the example of the present invention.

Hereinafter, the branch pipe of the present invention will be described more specifically. FIGS. 4 and 5 are views illustrating the branch pipe according to the example of the present invention. The branch pipe 300 may have a coolant discharge pipe 303 connected to the coolant discharge port 110B and configured such that the coolant discharged from the coolant discharge port is introduced into the coolant discharge pipe 303, and first and second branch pipes 301 and 302 respectively branching off from the coolant discharge pipe 303 in first and second directions. That is, as illustrated, the branch pipe 300 has a T shape. A left portion based on the drawings may correspond to the first branch pipe 301 based on the branch point, a right portion based on the drawings may correspond to the second branch pipe 302, and a lower portion based on the drawings may correspond to the coolant discharge pipe 303. However, the shape of the branch pipe is not limited thereto. The branch pipe may have a Y shape or various shapes such as a shape in which one or more branch pipes branch off from a main pipe. In this case, the coolant discharge pipe 303 may be disposed downward from the first branch pipe 301 and the second branch pipe 302 in a gravitational direction.

In this case, the first branch pipe 301 may transfer the coolant to the first coolant path, and the second branch pipe 302 may transfer the coolant to the second coolant path. In this case, the first coolant path may be a path through which the coolant is cooled, and the second coolant path may be a path through which the coolant is heated. That is, as described above, because the heat exchanger needs to condense the refrigerant during the process of cooling the vehicle, the radiator, which exchanges heat with outside air, may cool the coolant to provide a relatively low-temperature coolant. In this case, the coolant path may correspond to the first coolant path in the present invention. In addition, because the heat exchanger needs to heat the refrigerant during the process of heating the vehicle, the coolant may be heated by waste heat of the PE component (electrical component) to provide a relatively high-temperature coolant. In this case, the path may correspond to the second coolant path in the present invention. The coolant discharged to the first coolant path may pass through a low-temperature radiator (LTR) provided adjacent to a battery line, and the coolant discharged to the second coolant path may pass through a high-temperature radiator (HTR) provided adjacent to a line of the PE component (e.g., a motor, an inverter, or the like).

In this case, in the present invention, an outer diameter 301_D of the first branch pipe 301 may be equal to or larger than an outer diameter 302_D of the second branch pipe 302. A flow rate of the coolant is high during the cooling process, i.e., in case that the coolant flows to the first coolant path through the first branch pipe 301, whereas a flow rate of the coolant is relatively low during the heating process, i.e., in case that the coolant flows to the second coolant path through the second branch pipe 302 because a viscosity of the coolant is low or a cooling load of the PE component is low. Therefore, the outer diameter of the first branch pipe 301 may be equal to or larger than the outer diameter of the second branch pipe 302. More specifically, an outer diameter of an outlet side end of the first branch pipe 301 may be equal to or larger than an outer diameter of an outlet side end of the second branch pipe 302. To this end, the outer diameter may gradually increase from the outlet side end of the second branch pipe 302 to the outlet side end of the first branch pipe 301. Alternatively, the outer diameter changes in the vicinity of the branch point, and in the other portions, the outer diameter of the first branch pipe 301 may be equal to or larger than the outer diameter of the second branch pipe 302, as a whole.

Figure 6:
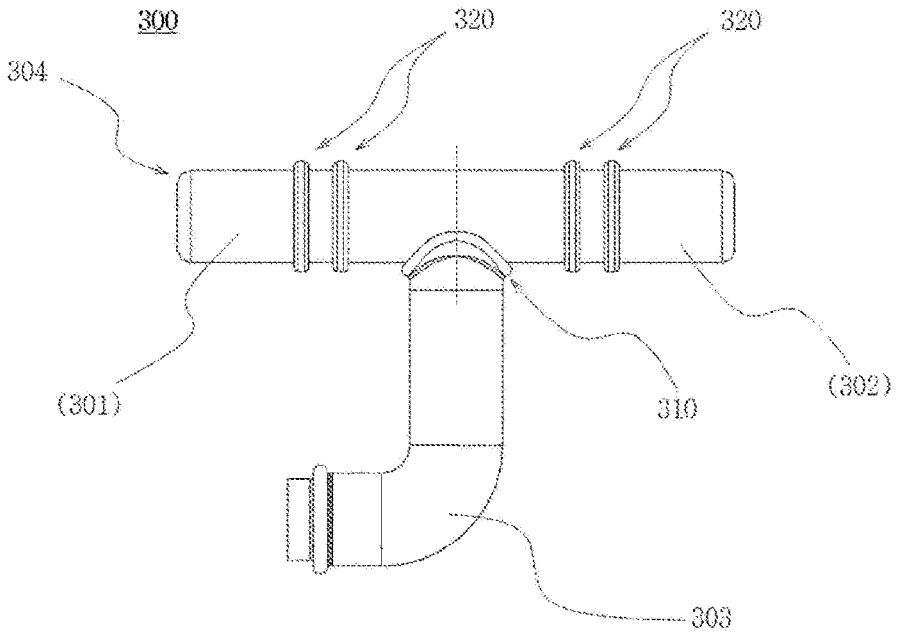
FIG. 6 is a top plan view of the branch pipe according to the example of the present invention.
Figure 7:
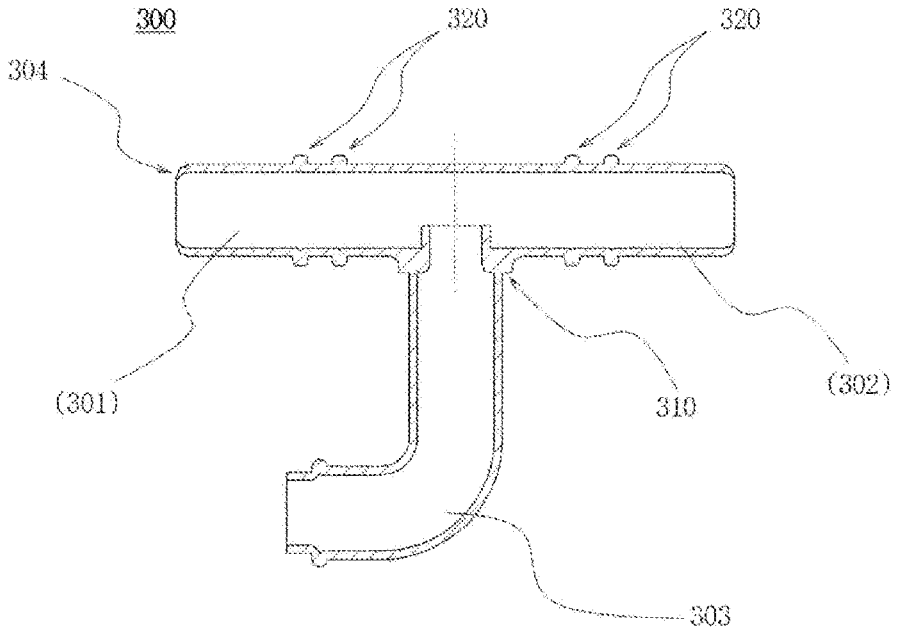
FIG. 7 is a cross-sectional view of FIG. 6.

FIG. 6 is a top plan view of the branch pipe according to the example of the present invention, and FIG. 7 is a cross-sectional view of FIG. 6. As illustrated, the branch pipe may have a T shape. In this case, the first and second branch pipes 301 and 302 may constitute an integrated pipe 304, and an end of the coolant discharge pipe 303 may be coupled to a middle portion of a lateral side of the integrated pipe 304.

In this case, the integrated pipe 304 and the coolant discharge pipe 303 may be coupled to each other by welding. That is, the integrated pipe 304 and the coolant discharge pipe 303 may each be configured as an extrusion pipe. The T-shaped branch pipe 300 may be manufactured by fixing and welding the coolant discharge pipe 303 to the middle portion of the lateral side of the integrated pipe 304.

As described above, the branch pipe 300 of the present invention may be manufactured by welding and coupling the integrated pipe 304 and the coolant discharge pipe 303. To this end, as illustrated in FIG. 5, a bead portion 310 may be provided at a coupling side end of the coolant discharge pipe 303 and have a coupling surface being in close contact with an outer peripheral surface of the integrated pipe 304. That is, the bead portion 310 may have a saddle shape and be in close contact with the integrated pipe 304, which makes it easy to fix a position of the coolant discharge pipe 303.

Further, a welded portion is formed to be thicker than the other portions, which enables strong welding and assists in increasing a coupling force between the two components.

Figure 8:
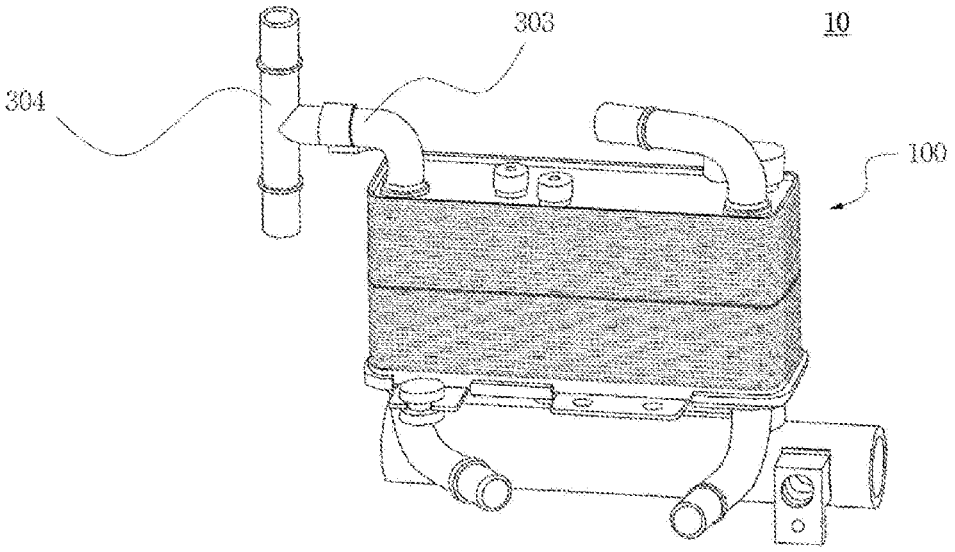
FIG. 8 is a view for explaining a welding process according to the example of the present invention.

FIG. 8 is a view for explaining a welding process according to the example of the present invention. As illustrated, the integrated pipe 304 may be vertically positioned so that a longitudinal direction of the integrated pipe 304 is parallel to the gravitational direction. The lateral side of the integrated pipe 304 may be fixed to the coolant discharge pipe 303 having an end side disposed in a horizontal direction, and the integrated pipe 304 and the coolant discharge pipe 303 may be coupled by welding. That is, during a process of manufacturing the branch pipe, the coolant discharge pipe 303 is fixed to the core part 100 first by welding or the like, and then the integrated pipe 304 may be coupled to the open end of the coolant discharge pipe 303 by welding. In this case, as described below, the coolant discharge pipe 303 may have a shape bent toward an upper side of the core part 100 so that the branch pipe 300 is positioned upward from the core part 100. Therefore, the end side of the coolant discharge pipe 303 may be disposed horizontally in a state in which the heat exchanger 10 lies. The welding may be performed after the integrated pipe 304 is perpendicularly positioned and fixed to the horizontal end side of the coolant discharge pipe 303.

In this case, during the welding process, a welding material produced from the bead portion 310 may flow downward by gravity along the integrated pipe 304, which may cause contamination. To prevent the problem, one or more protruding portions 320 may be provided on the integrated pipe 304 and protrude in a ring shape along the outer peripheral surface of the integrated pipe 304. Therefore, it is possible to prevent contamination caused by the welding material. In this case, for ease of manufacturing, the protruding portions 320 may be respectively provided on the first branch pipe 301 and the second branch pipe 302. Two or more protruding portions may be respectively provided on the first branch pipe 301 and the second branch pipe 302.

Unlike the configuration of the previous example in which the extrusion pipes are welded to each other to constitute the branch pipe, the branch pipe 300 according to another example of the present invention may be configured such that the first and second branch pipes 301 and 302 and the coolant discharge pipe 303 are integrated. That is, the branch pipe may be manufactured as a single product in which all the components are integrated by injection molding or the like. The heat exchanger may be manufactured by fixing the branch pipe, which is manufactured as a single separate product, to the coolant discharge port of the core part.

Figure 9:
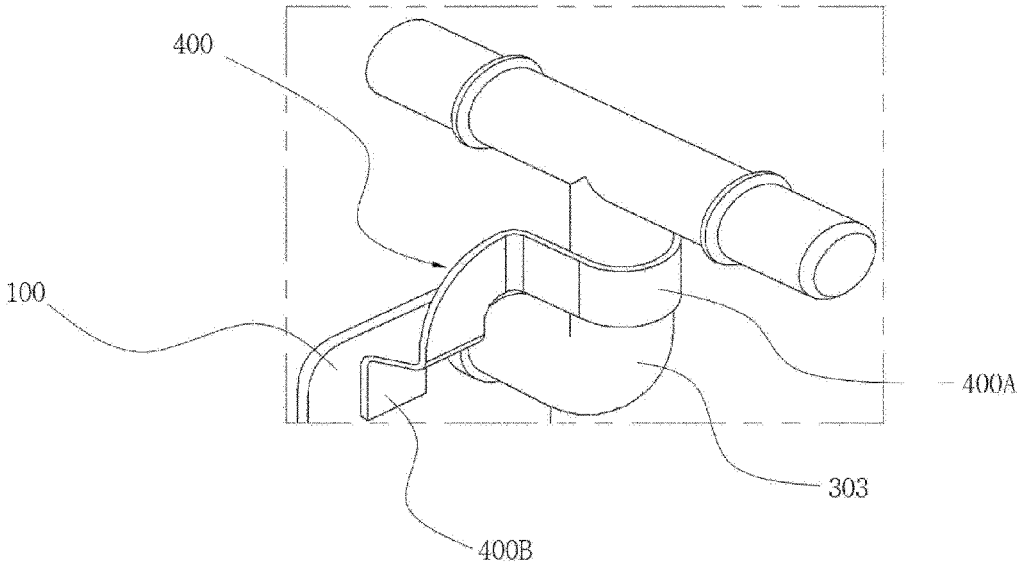
FIG. 9 is a view illustrating a fixing structure according to the example of the present invention.
Figure 10:
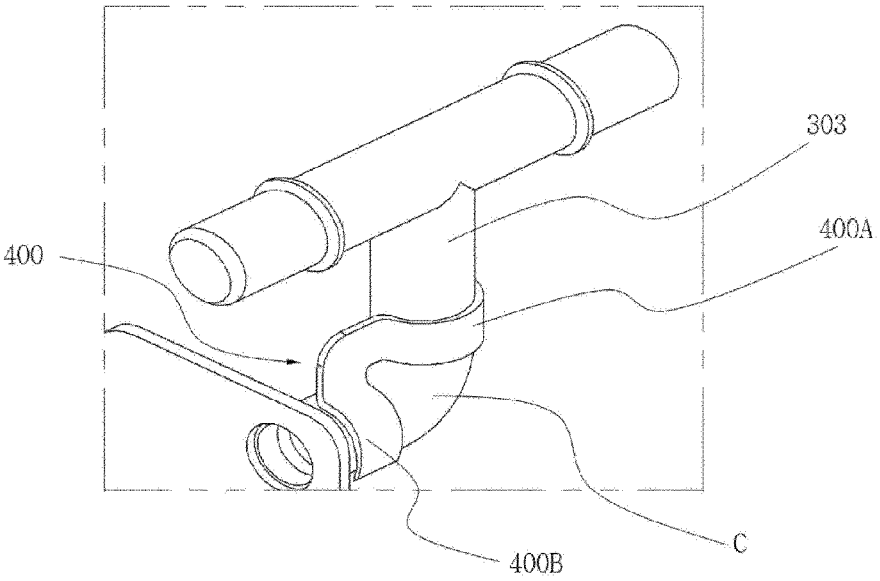
FIG. 10 is a view illustrating a fixing structure according to another example of the present invention.

Meanwhile, a fixing structure of the present invention will be described below. FIG. 9 is a view illustrating a fixing structure according to the example of the present invention, and FIG. 10 is a view illustrating a fixing structure according to another example of the present invention. As illustrated, a heat exchanger of the present invention may further include a fixing structure 400 for fixing the branch pipe 300.

As illustrated in FIG. 9, the fixing structure 400 according to the example of the present invention, one end 400A of the fixing structure 400 may be fixed to the coolant discharge pipe 303, and the other end 400B of the fixing structure 400 may be fixed to the core part 100. Because one side and the other side of the fixing structure are respectively fixed to the coolant discharge pipe and the core part that constitute the branch pipe as described above, the coupling force between the branch pipe and the core part may increase.

As illustrated in FIG. 10, in the fixing structure 400 according to another example of the present invention, both one end 400A and the other end 400B of the fixing structure 400 may be fixed to the coolant discharge pipe 303. That is, one end of the fixing structure 400 may be fixed to one point on the coolant discharge pipe 303, and the other end of the fixing structure 400 may be fixed to the other point on the coolant discharge pipe 303. The coolant discharge pipe 303 may include a bent portion C as the coolant discharge pipe 303 is bent at a middle point thereof as described above. A lower portion of the bent portion C may be parallel to the ground surface, and an upper portion of the bent portion C may be structured to be perpendicular to the ground surface. In this case, one end 400A of the fixing structure 400 may be fixed to the lower portion of the bent portion C that is the middle point, and the other end 400B of the fixing structure 400 may be fixed to the upper portion of the bent portion C that is the middle point. This assists in increasing the durability of the coolant discharge pipe because the fixing structure disperses stress concentrated on the bent portion of the coolant discharge pipe when the coolant flows.

Further, although not illustrated separately, the fixing structure may, of course, be configured by combining the above-mentioned structures of the two examples, i.e., configured by a configuration in which first and second sides of the fixing structure are fixed to the coolant discharge pipe, and a third side of the fixing structure is fixed to the core part.

In addition, as illustrated in FIGS. 9 and 10, the fixing structure 400 may be formed in an elongated plate shape, and at least one of one end and the other end of the fixing structure 400 may be formed to surround the outer peripheral surface of the coolant discharge pipe 303. Because the fixing structure is formed in a plate shape, a contact area between the fixing structure and a fixing target (i.e., the coolant discharge pipe or the core part) may be increased, and the fixing force may be increased. Because the fixing structure is configured to surround the outer peripheral surface of the coolant discharge pipe, the coupling force between the coolant discharge pipe and the fixing structure may be increased, and the two constituent elements may be coupled without a separate welding process.

Meanwhile, in the heat exchanger 10 of the present invention, the branch pipe 300 may be positioned upward from the core part 100. That is, with reference back to FIG. 2, the branch pipe 300, more specifically, the branch point on the branch pipe 300, i.e., the first branch pipe 301 and the second branch pipe 302 may be disposed at a position higher than the core part 100 based on the ground surface. Because the branch pipe is positioned at the upper side when the heat exchanger is installed in the vehicle, it is easy for an operator to approach the branch pipe when the operator performs an operation of discharging air in the core part.

While the embodiments of the present invention have been described with reference to the accompanying drawings, those skilled in the art will understand that the present invention may be carried out in any other specific form without changing the technical spirit or an essential feature thereof. Therefore, it should be understood that the above-described embodiments are illustrative in all aspects and do not limit the present invention.

DESCRIPTION OF REFERENCE NUMERALS

10: Heat exchanger
100: Core part
110A: Coolant inlet port
110B: Coolant discharge port
120A: Refrigerant inlet port

120B: Refrigerant discharge port
200: Gas-liquid separator
300: Branch pipe
301: First branch pipe
302: Second branch pipe
303: Coolant discharge pipe
304: Integrated pipe
400: Fixing structure

What is claimed is:

1. A heat exchanger comprising:
a core part in which heat exchange occurs between a refrigerant and a coolant;
a refrigerant inlet port through which the refrigerant is introduced into the core part;
a refrigerant discharge port through which the refrigerant is discharged from the core part;
a coolant inlet port through which the coolant is introduced into the core part;
a coolant discharge port through which the coolant is discharged from the core part; and
a branch pipe provided adjacent to the coolant discharge port and configured to distribute the coolant,
wherein the branch pipe comprises:
a coolant discharge pipe through which the coolant is introduced from the coolant discharge port; and
first and second branch pipes branching off from the coolant discharge pipe,
wherein the coolant discharge pipe is disposed downward from the first and second branch pipes in a gravitational direction, and
wherein the branch pipe has a structure in which the first and second branch pipes constitute an integrated pipe, and an end of the coolant discharge pipe is coupled to a middle portion of a lateral side of the integrated pipe.

2. The heat exchanger of claim 1, wherein the first branch pipe transfers the coolant to a first coolant path, the second branch pipe transfers the coolant to a second coolant path, the first coolant path is a path in which the coolant is cooled, and the second coolant path is a path in which the coolant is heated.

3. The heat exchanger of claim 2, wherein an outer diameter of the first branch pipe is equal to or larger than an outer diameter of the second branch pipe.

4. The heat exchanger of claim 1, wherein the integrated pipe and the coolant discharge pipe are coupled by welding.

5. The heat exchanger of claim 1, wherein a bead portion is provided at a coupling side end of the coolant discharge pipe and has a coupling surface having a shape being in close contact with an outer peripheral surface of the integrated pipe.

6. The heat exchanger of claim 1, wherein at least one protruding portion is provided on the integrated pipe and protrudes in a ring shape along an outer peripheral surface of the integrated pipe.

7. The heat exchanger of claim 1, wherein the branch pipe is positioned upward from the core part.

8. The heat exchanger of claim 1, wherein the core part is configured such that a plurality of plates, on which the coolant forward, and a plurality of plates, on which the refrigerant flows, are alternately stacked to perform heat exchange.

9. A heat exchanger comprising:
a core part in which heat exchange occurs between a refrigerant and a coolant;
a refrigerant inlet port through which the refrigerant is introduced into the core part;
a refrigerant discharge port through which the refrigerant is discharged from the core part;
a coolant inlet port through which the coolant is introduced into the core part;
a coolant discharge port through which the coolant is discharged from the core part; and
a branch pipe provided adjacent to the coolant discharge port and configured to distribute the coolant to different paths,
wherein the branch pipe comprises:
a coolant discharge pipe through which the coolant is introduced from the coolant discharge port;
first and second branch pipes branching off from the coolant discharge pipe; and
a fixing structure,
wherein the coolant discharge pipe comprises a bent portion extending from the core part and bent toward the first and second branch pipes, and
wherein one end of the fixing structure is fixed to a first point on the coolant discharge pipe, another end of the fixing structure is fixed to a second point on the coolant discharge pipe, and the bent portion is positioned between the first point and the second point.

10. The heat exchanger of claim 9 wherein one end of the fixing structure is fixed to the coolant discharge pipe, and another end of the fixing structure is fixed to the core part.

11. The heat exchanger of claim 9 wherein at least one of one end and the other end of the fixing structure surrounds an outer peripheral surface of the coolant discharge pipe.

* * * * *